US006386111B1

(12) United States Patent
Shann

(10) Patent No.: US 6,386,111 B1
(45) Date of Patent: May 14, 2002

(54) STEMMING ARRANGEMENT AND METHOD FOR BLAST HOLES

(75) Inventor: Peter Christian Shann, Fulford (GB)

(73) Assignee: Advanced Blasting Technology, Inc., Delancey, NY (US)

( * ) Notice: Subject to any disclaimer, the term of this patent is extended or adjusted under 35 U.S.C. 154(b) by 0 days.

(21) Appl. No.: 09/483,330

(22) Filed: Jan. 14, 2000

Related U.S. Application Data

(63) Continuation of application No. 09/101,393, filed as application No. PCT/GB97/02892 on Oct. 21, 1997, now abandoned.

(30) Foreign Application Priority Data

Nov. 4, 1996 (GB) ..... 9622942

(51) Int. Cl.[7] ..... F42B 3/00
(52) U.S. Cl. ..... 102/333; 102/312; 102/313
(58) Field of Search ..... 102/333, 312, 102/313

(56) References Cited

U.S. PATENT DOCUMENTS

| | | | | |
|---|---|---|---|---|
| 4,660,644 A | | 4/1987 | Egnor | 166/285 |
| 4,754,705 A | | 7/1988 | Worsey | 102/333 |
| 4,774,888 A | | 10/1988 | Jones et al. | 102/333 |
| 4,913,233 A | | 4/1990 | Fitzgibbon, Jr. | 166/285 |
| 5,000,261 A | | 3/1991 | Fitzgibbon, Jr. | 166/187 |
| 5,035,286 A | * | 7/1991 | Fitzgibbon, Jr. | 102/333 X |
| 5,497,829 A | | 3/1996 | Rajkovish | 102/333 |
| 5,841,060 A | * | 11/1998 | Skaggs | 102/333 |
| 5,979,327 A | * | 11/1999 | Thomson | 102/333 |

FOREIGN PATENT DOCUMENTS

DE 1 287 989 1/1969

* cited by examiner

*Primary Examiner*—Peter A. Nelson
(74) *Attorney, Agent, or Firm*—Madson & Metcalf

(57) ABSTRACT

The present invention relates to a stemming arrangement and stemming method for use in blast holes. A rigid but deformable hollow member is located in a blast hole with its curved shape providing a clearance between opposed wall portions. A stemming material is contained within the curved portion. Detonation of the explosive deforms the hollow member outwardly into contact with the opposed wall portions of the blast hole.

20 Claims, 3 Drawing Sheets

STEMMING ARRANGEMENT AND METHOD FOR BLAST HOLES

This appl, is a con't of Ser. No. 09/101,393 filed Jul. 15, 1998 Abandoned. which is a 371 PCT/GB97/02892 filed Oct. 21, 1997.

The present invention relates to a stemming arrangement and stemming method for use in blast holes having one or more explosive charges therein.

In many applications of blasting, for example in mining, a number of blast holes are drilled and one or more explosive charges is placed at the end of the blast hole. Detonation of the explosive charges then ruptures the surrounding rock to enable it to be removed.

Stemming of blast holes involves plugging the blast holes in order to avoid reduction in the effectiveness of the blasting operation caused by the escape of blast gases. Stemming has previously been carried out by simply filling the blast holes with suitable material, such as angular particles, which then resists escape of the blast gases because of the tendency of the particle of stemming material to lock together by (so-called "bridging") to resist flow and because of the friction of the stemming material against the blast hole walls.

However, such existing stemming techniques suffer from the drawback that the stemming material can under certain circumstances still be ejected from the blast hole, for example, when the outward force of blast gases is so great that fluidising of the stemming material causes the stemming material to flow towards the mouth of the blast hole. This not only reduces the effectiveness of the blast, but the ejection of stemming material out of the blast hole can also be hazardous. In order to minimise this effect, the length of blast hole available and which can be effectively stemmed is sometimes insufficient to allow the use of the desired optimum size of explosive charge.

U.S. Pat. No. 4,754,705 discloses a mechanical stemming construction for blast holes in which a tapering wedge member is positioned in the blast hole outwardly of an explosive charge with its narrower end facing towards the mouth of the blast hole. When the wedge member is located in the blast hole, particulate stemming material is loaded into the blast hole outwardly of the wedge member. Detonation of the explosive charge in the blast hole then causes the wedge member to be driven towards the mouth of the blast hole which in turn drives the wedge member into the stemming material. The outward movement of the wedge member compacts the stemming material causing the particles thereof to "bridge" and forces the stemming material laterally against the walls of the blast hole.

However, this stemming construction suffers from the drawback that it is often unsuitable for use in wet blast holes because of the tendency of moisture in the blast hole to penetrate the stemming material used and thus reduce the tendency of the particles of stemming material to "bridge" effectively. The wedge member of this construction is also required to be constructed from rigid materials.

In addition, this type of prior art stemming construction is often unsuitable for many decking applications, i.e. in which a number of explosive charges are separated by stemming material in the same blast hole and are detonated according to a predetermined sequence. Effective stemming in decking applications is important since ineffective stemming may cause the detonation of one explosive charge to compress an adjacent charge in the same blast hole thus rendering that charge ineffective. The construction of U.S. Pat. No. 4,754,705 is less flexible in decking applications in which stemming between two explosive charges in a single blast hole is required, since the wedge member is only effective against detonation gases arriving from one side thereof. This makes the construction unsuitable for use in a decking arrangement in which an explosive charge facing the narrower end of the wedge member is to be detonated before a charge facing the wider end.

A further disadvantage of this prior art stemming construction is that it generally requires the provision of a stabilising rod to correctly orient the wedge member in the blast hole. A protective layer of stemming material is located outwardly of the explosive charge to minimise the risk of the wedge member being destroyed by the initial detonation, and the wedge member is then located outwardly of the protective layer and with the appropriate orientation by means of the stabilising rod. The stabilising rod is then removed while the remainder of the blast hole is filled with stemming material. This procedure is often very difficult, if not impossible, to correctly achieve in the case of non vertical blast holes or blast holes of narrow diameter. In addition, mis-orientation of the wedge member can often occur after detonation.

German Patent Application No 1287989 discloses an elastic spherical body which in use contains an air-water mixture under excess pressure. The body is located outwardly in a borehole of water-containing capsules, and is of a flexible nature having an unconfined diameter greater than that of the borehole. This prior art device is intended primarily to serve to assist in maintaining the water-containing capsules in place prior to detonation and is not intended to fulfil any stemming function after detonation. Accordingly, the extent to which this device can provide any effective post-detonation stemming is very limited.

U.S. Pat. No. 4,913,233 discloses an inflatable device for plugging a borehole to enable explosives to be located at a desired location in the borehole. The device is used to preserve an unfilled void in the borehole such that upon detonation, high pressure gases may flow and do work in the void, thereby reducing the total amount of explosive used and increasing the effective use of explosives. It is an essential requirement that this prior art device allows gas to flow to the void, as a result of which the device has insufficient strength to resist gas flow caused by detonation of an explosive charge.

Preferred embodiments of the present invention seek to overcome the above disadvantages of the prior art.

According to an aspect of the present invention, there is provided a stemming arrangement for a blast hole having at least one explosive charge therein, the arrangement comprising:

at least one hollow member arranged in use in the blast hole outwardly of an associated explosive charge, wherein detonation of the associated explosive charge deforms the or each hollow member so as to substantially block the bore of the blast hole at the location of said hollow member to substantially impede outward passage of material past said hollow member, and the or each hollow member is made of sufficiently strong material to remain substantially functionally intact after detonation of the associated explosive charge.

By providing a hollow member which deforms to substantially block the bore of the blast hole, this gives the advantage of in effect creating an impermeable membrane which substantially prevents the passage of material past the or each hollow member. By "material" is meant gas and/or liquid and/or fluidised stemming material. As a result, the arrangement can therefore be effectively used in wet blast holes.

By "functionally intact" is meant that the hollow member remains sufficiently intact as to effect control of explosively induced forces during the rock breaking process caused by the detonation.

Preferably, the or each hollow member has a respective internal surface substantially enclosing a respective internal space.

It will be appreciated by persons skilled in the art that the term "substantially enclose" encompasses one or more hollow members which do not entirely enclose the respective internal space, but allow air to pass from the interior of the hollow member to the exterior thereof on deformation of the hollow member as a result of detonation of the associated explosive charge.

The or each hollow member may be substantially liquid tight.

In a preferred embodiment, the or each hollow member is substantially spherical.

This has the advantage of making the stemming arrangement particularly suitable for decking applications because it is effective against detonation gases arriving from both sides thereof in the blast hole. By providing a substantially spherical member, this gives the further advantage of minimising any tendency of the detonation forces to rotate the hollow member about an axis transverse to the blast hole axis, which otherwise could result in failure of the stemming operation.

The or each hollow member may comprise first and second cooperating substantially hemispherical portions.

The or each hollow member is preferably at least partially filled with stemming material.

In a preferred embodiment, the or each hollow member is at least partially filled with a stemming material comprising gravel.

The or each hollow member preferably comprises plastics material.

This has the advantage of enabling the hollow member to be manufactured relatively inexpensively.

The plastics material may comprise polyethylene.

Alternatively, the plastics material may comprise PET.

The arrangement may further comprise a buffer layer of stemming material arranged between a said hollow member and the associated explosive charge.

This has the advantage of minimising damage to the hollow member as a result of the initial detonation of the associated explosive charge which may impede the operation of the arrangement to block the passage of detonation gases.

The arrangement preferably further comprises particulate stemming material arranged in the blast hole, at least part of the stemming material being arranged outwardly of the or each hollow member.

In a preferred embodiment the or each hollow member has a wall thickness between substantially 0.5% to 75% of the external diameter of said hollow member, and preferably between substantially 1% and 6% of the external diameter of said hollow member.

According to another aspect of the invention, there is provided a method of stemming a blast hole having at least one explosive charge therein, the method comprising:

locating at least one hollow member in the blast hole outwardly of an associated explosive charge, wherein detonation of the associated explosive charge deforms the or each hollow member so as to substantially block the bore of the blast hole at the location of said hollow member and substantially impede outward passage of material past said member, and the or each said hollow member made of sufficiently strong material to remain substantially functionally intact after detonation of the associated explosive charge.

The method preferably further comprises the step of providing a buffer layer of stemming material between a said hollow member and the associated explosive charge.

The method preferably further comprises the step of locating stemming material in the blast hole such that at least part of the stemming material is arranged outwardly of the or each hollow member.

As an aid to understanding of the invention, a preferred embodiment thereof will now be described in detail below, by way of example only and not in any limitative sense, with reference to the accompanying drawing, in which.

Figure 1:
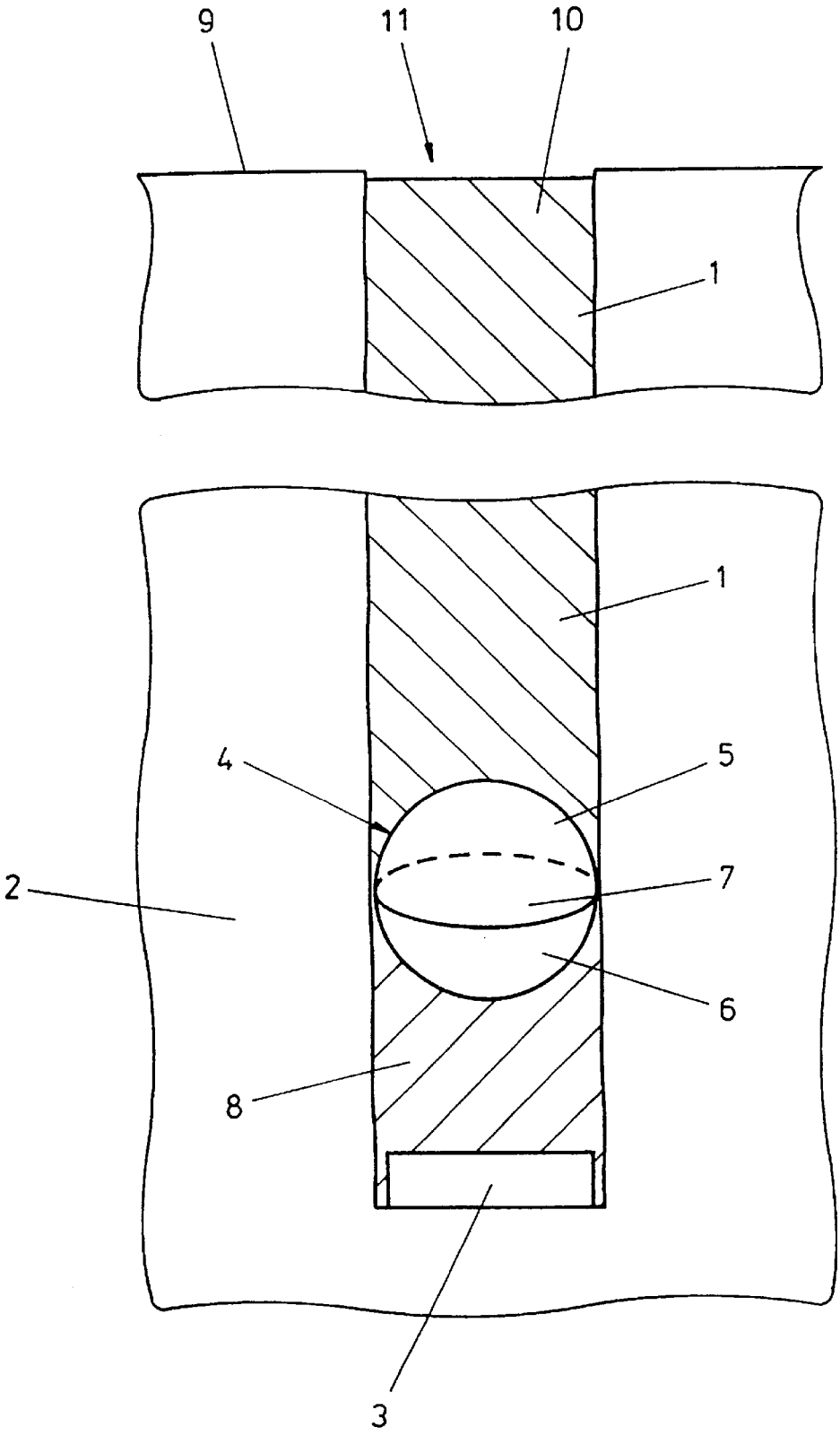
FIG. 1 is a schematic elevation view of a stemming arrangement embodying the present invention.

Referring to FIG. 1, a blast hole 1 is formed in a body of rock 2 by drilling and has an explosive charge 3 located at its innermost end. It will be appreciated by persons skilled in the art that the Figure shows an illustrative example only and that more than one explosive charge 3 may be located in the blast hole 1.

A hollow generally spherical member 4 of plastics material is formed from a first generally hemispherical part 5 and a second generally hemispherical part 6 which are adapted to fit together such that the first part 5 overlies the second part 6 at an overlapping region 7.

The spherical member 4 may be formed from any suitable liquid tight material capable of being deformed, rather than ruptured, by the force of blast gases generated by the detonation of the explosive charge 3. Hydrocode analysis shows that a material flow regime in which fluid flow is fastest at the axial centre of the blast hole 1 is substantially responsible for fluidisation of stemming material, which in turn prevents effective bridging of the particles of stemming material. A suitable material for constructing the spherical member 4 is therefore one having sufficient tensile strength to withstand the significant differential pressure across the blast hole radius associated with such a flow regime, and a typical material may be low density polyethylene or PET. For a typical blast hole diameter of 100 mm, typical wall thicknesses of the first 5 and second 6 parts of the spherical member 4 would be between 1 mm and 10 mm, typically 3 to 4 mm.

The spherical member 4 is filled with sand and/or gravel and the first 5 and second 6 parts are fitted together so that the hollow member 4 is substantially liquid tight.

A buffer layer 8 of particulate stemming material, of which a number of suitable materials will be known to persons skilled in the art, is located outwardly of the explosive charge 3 and the spherical member 4 is then located outwardly of the buffer layer 8, either by being dropped down the vertical blast hole 1 shown in the Figure or, in the case of a non-vertical blast hole, by being placed by means of a suitable rod (not shown). The buffer layer 8 will typically have a thickness of between one and ten blast hole radii so as to optimise the balance of the bridging effect in the stemming material above and below the spherical member 4. When the spherical member 4 has been located in position, the remainder of the bore of the blast hole 1 is filled with stemming material 10, which would preferably be a material comprising angular particles and therefore suitable for effective "bridging".

The spherical member 4 has a diameter slightly less than that of the blast hole 1, to enable suitable detonation wires (not shown) to extend along the blast hole 1 past the spherical member 4 to the ground surface 9.

The operation of the stemming arrangement shown in the Figure will now be described.

When the explosive charge 3 is detonated, blast gases are driven towards the spherical member 4 with considerable force. As a result, the spherical member 4 is deformed and the sand located therein is compressed, while water penetration is prevented, causing the particles thereof to "bridge". The deformation of the member 4 causes it to flatten in the longitudinal direction of the blast hole 1 while causing it to expand in the transverse direction to substantially block the bore of the blast hole 1. As a result, the deformed member 4 with the "bridged" sand therein forms a substantially gas impermeable membrane which substantially prevents the passage of detonation gases past the member 4 in the direction of the mouth 11 of the blast hole 1. The effect of any blast gases which actually pass the member 4 is minimised by the presence of the stemming material 10 in the remainder of the blast hole 1.

Consequently, in the critical phase following detonation of the explosive charge 3, the detonation gases are either prevented altogether from passing the member 4 (which may be displaced a considerable distance towards the mouth 11 of the blast hole 1), or to an insufficient extent to cause fluidisation of the stemming material 10 located outwardly of the member 4 which in turn prevents the stemming material 10 from being ejected from the blast hole 1.

Figure 2A:
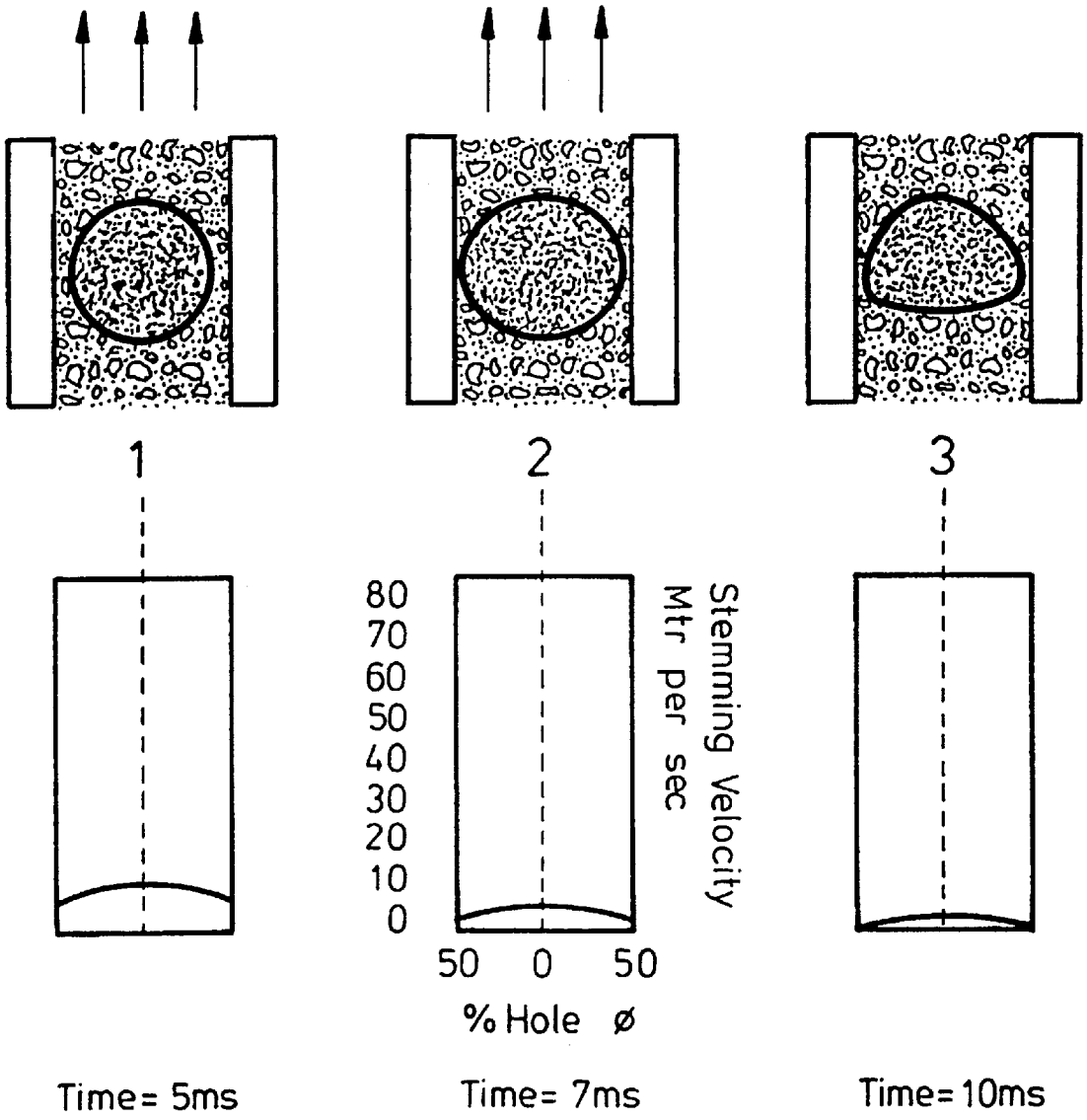
FIG. 2A shows the behaviour of the stemming arrangement of FIG. 1 in the period immediately following detonation of an explosive charge.
Figure 2B:
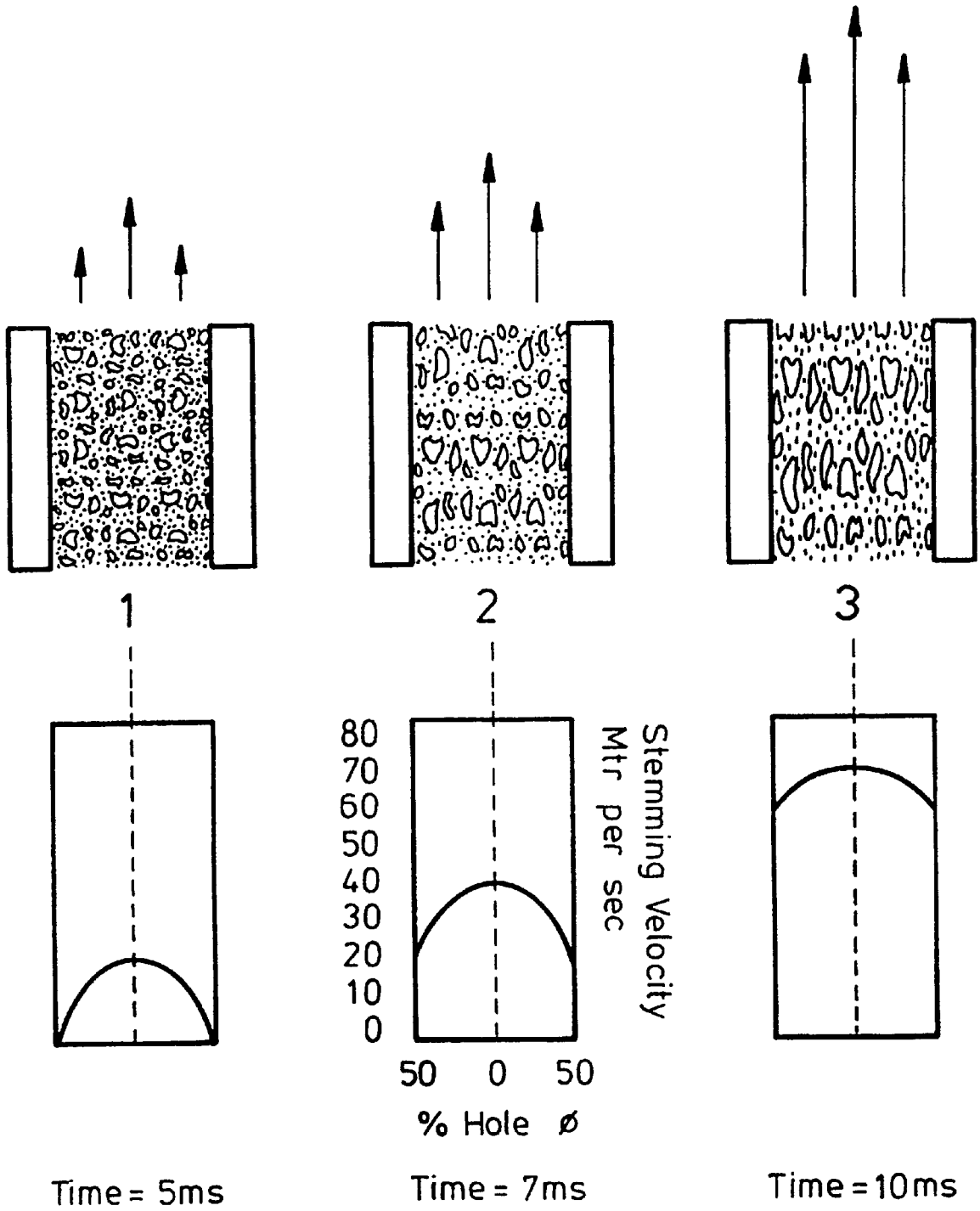
FIG. 2B shows the behaviour of a conventional borehole containing stemming material in the period immediately following detonation.

In particular, referring to FIGS. 2A and 2B, which show the operation of the spherical member 4 located in the blast hole 1 compared with a blast hole only containing stemming material, a stemming material close to the explosive charge on detonation receives a greater pressure impulse near the axial centre of the borehole 1 than at the edges. This drives the stemming material towards the spherical member 4, which in turn prevents ejection of stemming material from the borehole by absorbing and equalising the pressure field across the borehole, and blocking high pressure gas permeation of the stemming material. The spherical member 4 thus flexes under explosive loading to create a frictional gas impermeable seal. By contrast, as shown in FIG. 2B, the stemming material at the axial centre of the borehole 1 has a greater upward velocity, and one significant differential particle flow between the stemming material at the centre and the edge of the borehole as established, bridging of the stemming material becomes impossible and the stemming material is subsequently ejected from the borehole.

It will be appreciated by persons skilled in the art that the above embodiment has been described by way of example only and not in any limitative sense, and that various alterations and modifications are possible without departure from the scope of the invention as defined by the appended claims.

What is claimed is:

1. A stemming arrangement for a blast hole having at least one explosive charge therein, the arrangement comprising:

at least one rigid hollow member arranged in use in the blast hole outwardly of an associated explosive charge said hollow member having an undeformed curved shape such that it fits with clearance between opposed wall portions of the blast hole, said curved shape defining an internal space configured to contain a stemming material when used in the blast hole; and wherein detonation of the associated explosive charge deforms the hollow member from its undeformed position so as to substantially block the bore of the blast hole at the location of the hollow member to substantially impede outward passage of material past the hollow member, and the hollow member is made of sufficiently strong material to remain substantially functionally intact after detonation of the associated explosive charge.

2. A stemming arrangement according to claim 1, wherein the hollow member has a respective internal surface substantially enclosing a respective internal space.

3. A stemming arrangement according to claim 1, wherein the hollow member is substantially liquid tight.

4. A stemming arrangement according to claim 1, wherein the hollow member is substantially spherical.

5. A stemming arrangement according to claim 4, wherein the hollow member comprises first and second cooperating substantially hemispherical portions.

6. A stemming arrangement according to claim 1, wherein the hollow member is at least partially filled with stemming material.

7. A stemming arrangement according to claim 6, wherein the hollow member is at least partially filled with a stemming material comprising gravel.

8. A stemming arrangement according to claim 1, wherein the hollow member is made of plastics material.

9. A stemming arrangement according to claim 8, wherein the plastics material comprises polyethylene.

10. A stemming arrangement according to claim 1, wherein the plastics material comprises PET.

11. A stemming arrangement according to claim 1, further comprising a buffer layer of stemming material arranged between a said hollow member and the associated explosive charge.

12. A stemming arrangement according to claim 1, further comprising particulate stemming material arranged in the blast hole, at least part of the stemming material being arranged outwardly of the hollow member.

13. A stemming arrangement according to claim 1, wherein the hollow member has a wall thickness between substantially 0.5% to 75% of the external diameter of said hollow member, and preferably between substantially 1% and 6% of the external diameter of said hollow member.

14. A method of stemming a blast hole having at least one explosive charge therein, the method comprising:

locating at least one rigid hollow member in the blast hole outwardly of an associated explosive charge, said hollow member having an undeformed curved shape such that it fits with clearance between opposed wall portions of the blast hole, said curved shape defining an internal space configured to contain a stemming material when used in the blast hole; and detonating the associated explosive charge so as to generate an explosive force moving outwardly of the blast hole and with the major portion of the force impacting initially substantially centrally of said undeformed hollow member so as to deform the hollow member outwardly into contact with the opposed wall portions of the blast hole so as substantially to block the bore of the blast hole at the location of the hollow member and substantially impede outward passage of material past said member, and the hollow member being made of sufficiently strong material to remain substantially functionally intact after detonation of the associated explosive charge and thereby contain the explosive charge within the blast hole inwardly of the hollow member.

15. A method according to claim 14, further comprising the step of providing a buffer layer of stemming material between a said hollow member and the associated explosive charge.

16. A method according to claim 14, further comprising the step of locating stemming material in the blast hole such that at least part of the stemming material being arranged outwardly of the hollow member.

17. A method according to claim 15, further comprising the step of locating stemming material in the blast hole such that at least part of the stemming material being arranged outwardly of the hollow member.

18. A stemming arrangement according to claim 2, wherein the hollow member is substantially liquid tight.

19. A stemming arrangement according to claim 18, wherein the hollow member is substantially spherical.

20. A stemming arrangement according to claim 19, wherein the hollow member comprises first and second cooperating substantially hemispherical portions.

* * * * *